US011442389B2

(12) United States Patent
Kyotani et al.

(10) Patent No.: US 11,442,389 B2
(45) Date of Patent: Sep. 13, 2022

(54) IMAGE FORMING APPARATUS INCLUDING TRANSFER UNIT AND CAPABLE OF DETERMINING LIFETIME OF TRANSFER UNIT

(71) Applicant: BROTHER KOGYO KABUSHIKI KAISHA, Nagoya (JP)

(72) Inventors: Tadao Kyotani, Nagoya (JP); Chieko Mimura, Nagoya (JP); Keita Suzuki, Nishio (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/386,835

(22) Filed: Jul. 28, 2021

(65) Prior Publication Data

US 2022/0035293 A1 Feb. 3, 2022

(30) Foreign Application Priority Data

Jul. 29, 2020 (JP) ..... JP2020-128275

(51) Int. Cl.
*G03G 15/00* (2006.01)

(52) U.S. Cl.
CPC ..... *G03G 15/55* (2013.01)

(58) Field of Classification Search
CPC ..... G03G 15/55; G03G 15/553
See application file for complete search history.

(56) References Cited

U.S. PATENT DOCUMENTS

2009/0245829 A1* 10/2009 Hamaya ..... G03G 21/0058 399/50
2016/0378034 A1* 12/2016 Taniguchi ..... G03G 15/502 399/81
2020/0103819 A1 4/2020 Hatano

FOREIGN PATENT DOCUMENTS

JP 2020-52329 A 4/2020

* cited by examiner

*Primary Examiner* — Carla J Therrien
(74) *Attorney, Agent, or Firm* — Merchant & Gould P.C.

(57) ABSTRACT

An image forming apparatus includes a photosensitive drum, a transfer unit, a voltage supply circuit, and a controller. The transfer unit is configured to transfer developer onto a printing medium from the photosensitive drum. The voltage supply circuit is configured to supply voltage to the transfer unit. The controller is electrically connected to the voltage supply circuit. The controller is configured to: calculate a cumulative voltage value, the cumulative voltage value being a total of supplied voltage to the transfer unit from the voltage supply circuit after using the transfer unit is started; and determine how long a lifetime of the transfer unit remains based on the calculated cumulative voltage value.

13 Claims, 11 Drawing Sheets

FIG. 5

T

| CONTRACT INFORMATION | TYPE OF TRANSFER UNIT | |
|---|---|---|
| | FIRST TRANSFER UNIT | SECOND TRANSFER UNIT |
| ORDINARY | USABLE・EXTENDABLE | UNUSABLE |
| FIRST CONTRACT | USABLE・EXTENDABLE | USABLE・UNEXTENDABLE |
| SECOND CONTRACT | USABLE・EXTENDABLE | USABLE・EXTENDABLE |

IMAGE FORMING APPARATUS INCLUDING TRANSFER UNIT AND CAPABLE OF DETERMINING LIFETIME OF TRANSFER UNIT

CROSS REFERENCE TO RELATED APPLICATION

This application claims priority from Japanese Patent Application No. 2020-128275 filed Jul. 29, 2020. The entire content of the priority application is incorporated herein by reference.

TECHNICAL FIELD

The present disclosure relates to an image forming apparatus.

BACKGROUND

There are conventionally known electrophotographic image forming apparatuses such as a laser printer and an LED printer. Such an image forming apparatus has a photosensitive drum and a transfer unit. When printing is performed in the image forming apparatus, a print sheet is fed between the photosensitive drum and the transfer unit. A developer is transferred from the photosensitive drum onto the print paper at the position between the photosensitive drum and the transfer unit.

Such an image forming apparatus having a transfer unit is disclosed in prior art, for example.

SUMMARY

The above-described image forming apparatus supplies a voltage to the transfer unit. The developer on the surface of the photosensitive drum is transferred from the photosensitive drum onto the print sheet by an electrostatic force generated by the voltage of the transfer unit. However, when the transfer unit is used in the image forming apparatus for a prolonged period of time, the transfer unit may deteriorate due to repeated voltage supply from the image forming apparatus.

In view of foregoing, it is an object of the present disclosure is to provide an image forming apparatus having a transfer unit whose lifetime can be determined in consideration of degradation of the transfer unit due to repeated voltage supply.

In order to attain the above and other objects, according to one aspect, the disclosure provides an image forming apparatus including a photosensitive drum, a transfer unit, a voltage supply circuit, and a controller. The transfer unit is configured to transfer developer onto a printing medium from the photosensitive drum. The voltage supply circuit is configured to supply voltage to the transfer unit. The controller is electrically connected to the voltage supply circuit. The controller is configured to: calculate a cumulative voltage value, the cumulative voltage value being a total of supplied voltage to the transfer unit from the voltage supply circuit after using the transfer unit is started; and determine how long a lifetime of the transfer unit remains based on the calculated cumulative voltage value.

BRIEF DESCRIPTION OF THE DRAWINGS

The particular features and advantages of the disclosure will become apparent from the following description taken in connection with the accompanying drawings, in which:

FIG. 5 is a view illustrating an example of a table showing a relationship between contract information and transfer unit type, and usage mode of the transfer unit;

DETAILED DESCRIPTION

Hereinafter, embodiments of the present disclosure will be described while referring to the accompanying drawings.

<1. Configuration of Image Forming Apparatus>

Figure 1:
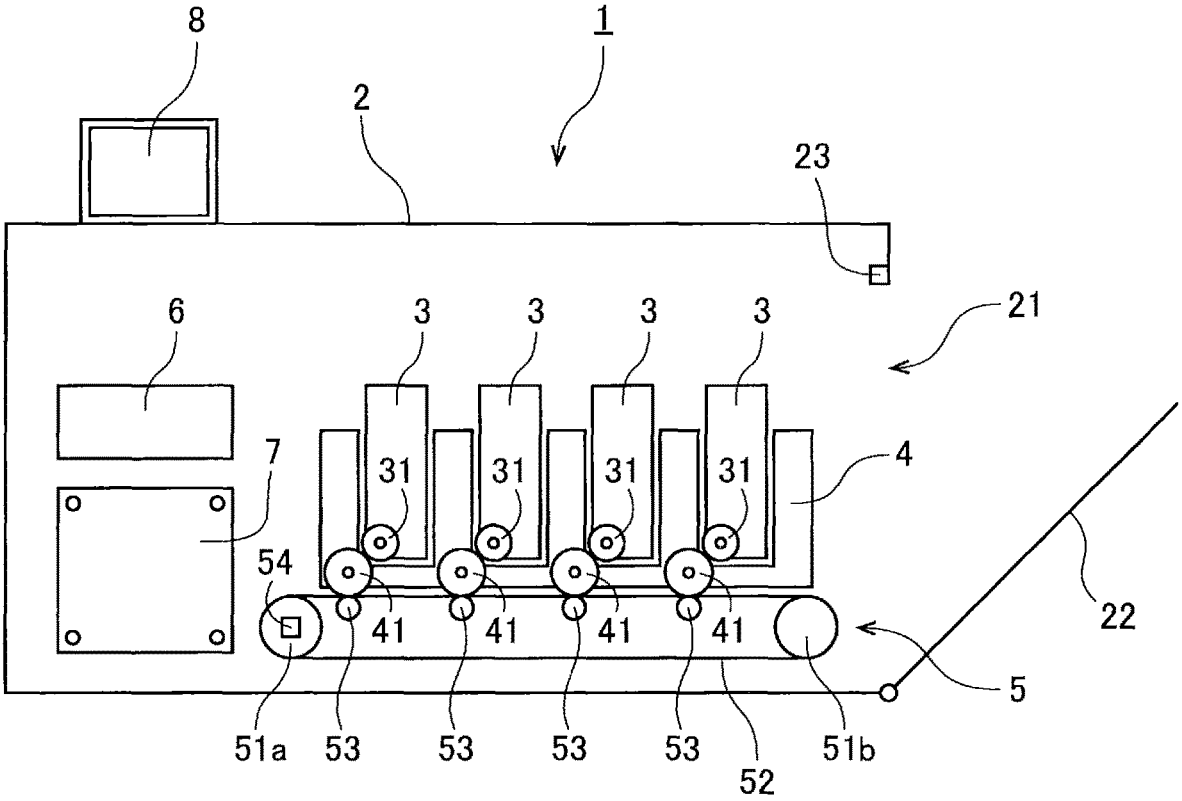
FIG. 1 is a conceptual view of an image forming apparatus according to one embodiment of the present disclosure.

FIG. 1 is a conceptual view of an image forming apparatus 1. The image forming apparatus 1 is an electrophotographic printer. Specifically, the image forming apparatus 1 is a laser printer or an LED printer. The image forming apparatus 1 has a main frame 2, four developing cartridges 3, a drum cartridge 4, a transfer unit 5, a voltage supply circuit 6, a controller 7, and a display 8.

The main frame 2 has an insertion opening 21 and a cover 22. The cover 22 is pivotally movable between an open position and a closed position. The open position is a position where the cover 22 opens the insertion opening 21, and the closed position is a position where the cover 22 closes the insertion opening 21. The image forming apparatus 1 has a cover sensor 23. The cover sensor 23 is configured to detect whether the cover 22 is pivoted from the open position to the closed position. When the cover sensor 23 detects that the cover 22 is pivoted from the open position to the closed position, a detection signal indicating that the cover 22 is pivoted to the closed position is sent to the controller 7.

Each of the four developing cartridges 3 can be individually attached to and detached from the drum cartridge 4. The drum cartridge 4, to which the four developing cartridge 3 are attached, can be attached to and detached from the main casing 2 through the insertion opening 21. That is, the four developing cartridges 3 can be attached to and detached from the main frame 2 in a state of being attached to the drum cartridge 4.

Each of the four developing cartridges 3 includes a developing roller 31. The drum cartridge 4 includes four photosensitive drums 41. When each of the developing cartridge 3 is attached to the drum cartridge 4, the developing roller 31 is in contact with a corresponding one of photosensitive drum 41. The four developing cartridges 3 store developer of respective colors such as cyan, magenta, yellow, and black, respectively.

The transfer unit 5 is a unit for transferring the developer from the photosensitive drums 41 to a print sheet (printing medium). The transfer unit 5 is attachable to and detachable from the main frame 2. The transfer unit 5 includes a first pulley 51*a*, a second pulley 51*b*, a transfer belt 52, and four transfer rollers 53. The transfer belt 52 is an annular flat belt. The transfer belt 52 is stretched between the first and second pulleys 51*a* and 51*b*. The first pulley 51*a* rotates by receiving power output from a motor (not shown). The rotation of the first pulley 51*a* causes rotation of the transfer belt 52 between the first and second pulleys 51*a* and 52*b*. The second pulley 51*b* rotates following the rotation of the transfer belt 52.

Each of the four transfer rollers 53 is a roller for transferring the developer from a corresponding one of photosensitive drums 41 to the print sheet. In a state where the transfer unit 5 is attached to the main frame 2 and where the drum cartridge 4, to which the four developing cartridges 3 are attached, is attached to the main frame 2, a part of the transfer belt 52 is positioned between the four photosensitive drums 41 and the four transfer rollers 53.

Figure 2:
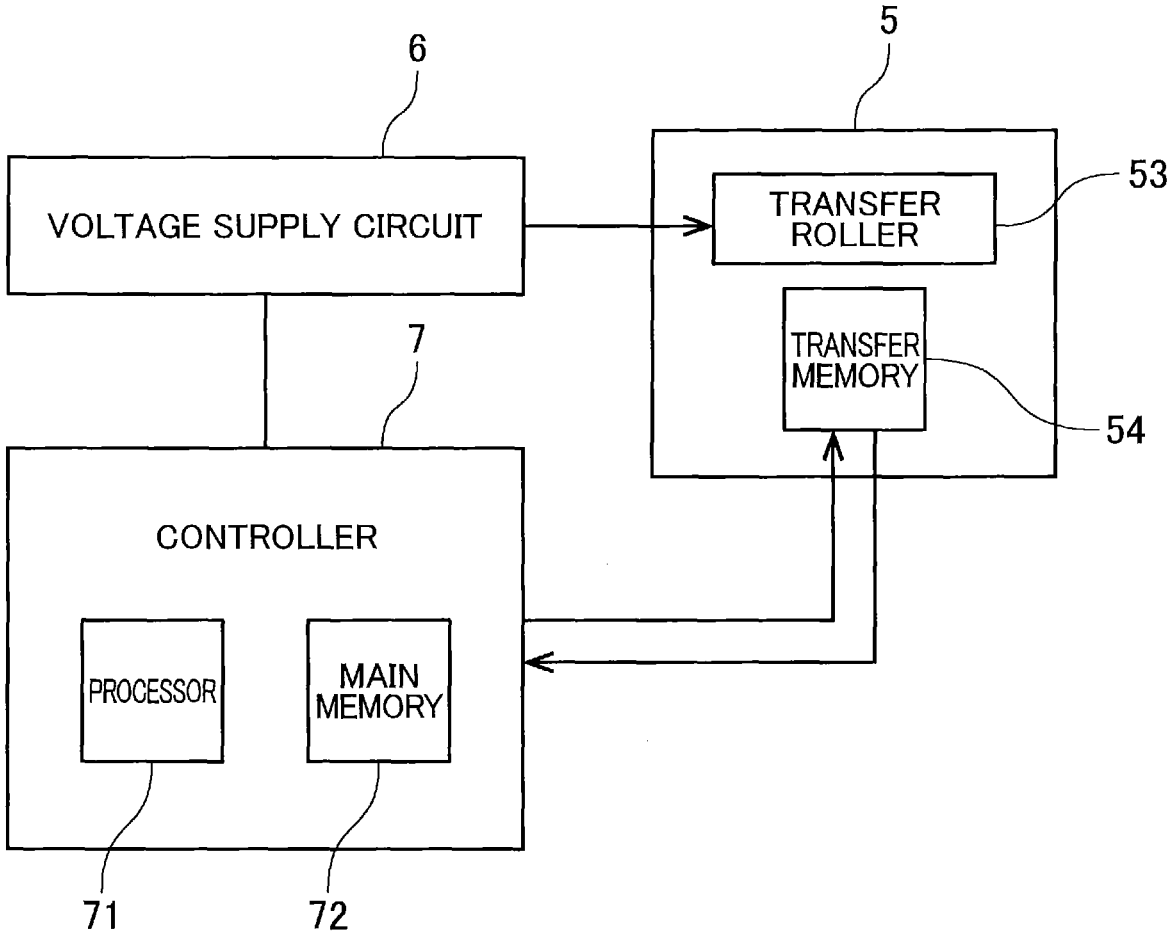
FIG. 2 is a block diagram illustrating electrical connection between a voltage supply circuit, a controller, and a transfer unit.

The voltage supply circuit 6 is an electric circuit for supplying a voltage to the transfer rollers 53. FIG. 2 is a block diagram illustrating electrical connection between the voltage supply circuit 6, the controller 7, and the transfer unit 5. As illustrated in FIG. 2, the voltage supply circuit 6 is electrically connected to the controller 7. In a state where the transfer unit 5 is attached to the main frame 2, the voltage supply circuit 6 is electrically connected to the four transfer rollers 53.

The controller 7 is positioned inside of the main frame 2 of the image forming apparatus 1. As illustrated in FIG. 2, the controller 7 includes a processor 71 such as a CPU and a main memory 72. The main memory 72 is a storage medium, to which information can be written and from which information can be read. The processor 71 can execute a reading process to read information from the main memory 72 and writing process to write information to the main memory 72. The controller 7 executes various processes in the image forming apparatus 1 by the processor 71 operating according to a program stored in the main memory 72.

The display 8 is, for example, a liquid crystal display or an organic EL display. The display 8 is electrically connected to the controller 7. The display 8 is configured to display various information with respect to the operation of the image forming apparatus 1 on a screen according to an instruction from the controller 7.

When printing is performed in the image forming apparatus 1, the developer contained in the developing cartridge 3 is supplied to the photosensitive drum 41 through the developing roller 31. The developer moves from the developing roller 31 to the photosensitive drum 41 according to an electrostatic latent image formed on the outer peripheral surface of the photosensitive drum 41. The print sheet is conveyed between the transfer belt 52 and the four photosensitive drums 41. The developer retained on the outer peripheral surface of the photosensitive drum 41 is transferred onto the print sheet by an electrostatic force generated by a voltage supplied from the voltage supply circuit 6 to the transfer roller 53. As a result of transferring the developer, a print image is formed on the surface of the print sheet.

<2. Subscription Contract>

A user of the image forming apparatus 1 can conclude a subscription contract concerning the transfer unit 5 with a supplier thereof. When no subscription contract is concluded between the user and the supplier, the user attaches a transfer unit 5 which the user individually purchases to the main frame 2. On the other hand, when the subscription contract is concluded, the user attaches a transfer unit 5 which is supplied by the supplier of the transfer unit 5 to the main frame 2 and use the image forming apparatus 1.

In the present embodiment, the user can conclude any one of two subscription contracts (first contract and second contract) with the supplier of the transfer unit 5. The first contract is a contract in which a normal type transfer unit 5 (hereinafter, referred to as "first transfer unit") is provided from the supplier. The second contract is a contract in which a transfer unit 5 (hereinafter, referred to as "second transfer unit") less expensive than the first transfer unit is provided from the supplier.

The main memory 72 stores contract information indicating whether the above-described subscription contract exists or which one of the first and second contracts the type of the subscription contract is. Specifically, the main memory 72 stores, as the contract information, any one of "normal", "first contract", and "second contract". The "normal" indicates that the user does not conclude the subscription contract with the supplier of the transfer unit 5. The "first contract" indicates that the user concludes the first contract with the supplier of the transfer unit 5. The "second contract" indicates that the user concludes the second contract with the supplier of the transfer unit 5.

<3. Transfer Memory>

As illustrated in FIGS. 1 and 2, the transfer unit 5 includes a transfer memory 54. The transfer memory 54 is a storage medium that allows reading and writing of information. In a state where the transfer unit 5 is attached to the main frame 2, the transfer memory 54 is electrically connected to the controller 7. As a result of establishing the electrical connection between the transfer memory 54 and the controller 7, the controller 7 can read the information from the transfer memory 54 and write the information to the transfer memory 54.

The transfer memory 54 stores various information related to the transfer unit 5. The various information includes "cumulative number of printed sheets", "cumulative number of rotations", "cumulative voltage value", "sample time", "sample count", and "type of the transfer unit". The transfer memory 54 may store only some of the various information.

The cumulative number of printed sheets indicates the cumulative number of sheets printed using the transfer unit 5 after using of the transfer unit 54 in the image forming apparatus 1 is started. The cumulative number of rotations indicates the cumulative number of rotations of the transfer belt 52 after the using of the transfer unit 54 in the image forming apparatus 1 is started. The cumulative voltage value indicates the sum of the voltage values supplied from the voltage supply circuit 6 to the transfer rollers 53 after the using of the transfer unit 54 in the image forming apparatus 1 is started. The sample time indicates the time interval for calculating the cumulative voltage value in a cumulative voltage value calculation process to be described later. The sample count indicates the number of times of calculation of the cumulative voltage value in the cumulative voltage value calculation process to be described later. The type of the transfer unit indicates whether the transfer unit 5 is the "first transfer unit" or "second transfer unit".

<4. Process of Controller>

The following describes processes performed by the controller 7 in the image forming apparatus 1.

<4-1. Initial Process>

Figure 3:
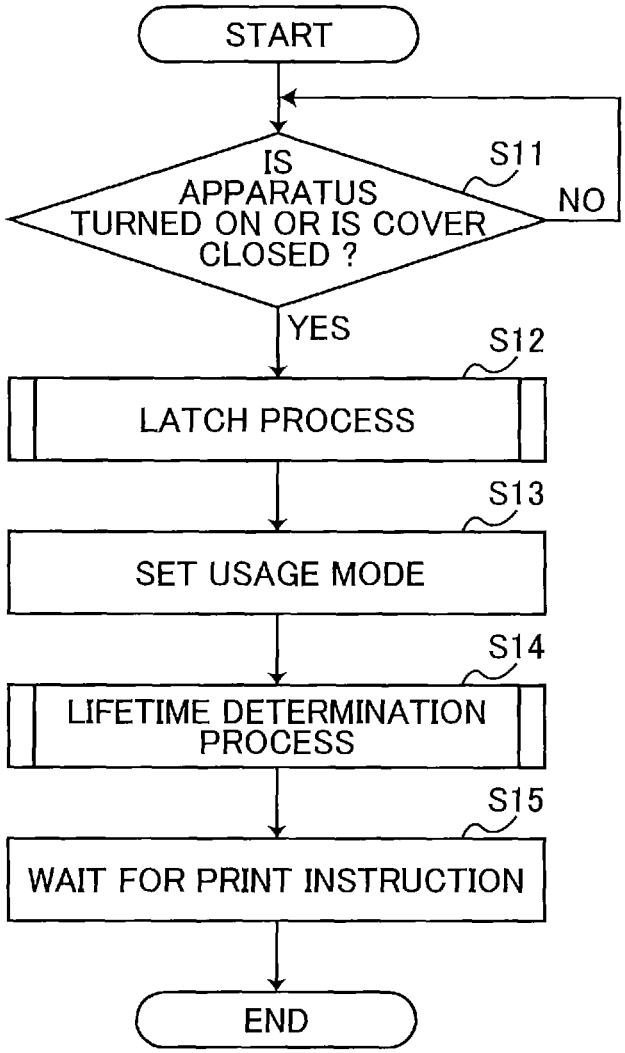
FIG. 3 is a flowchart illustrating steps in an initial process.

First, an initial process will be described. The initial process is executed by the controller 7 when the power of the image forming apparatus 1 is turned from an OFF state to an ON state or when the cover 22 of the image forming apparatus 1 is closed. FIG. 3 is a flowchart illustrating steps of the initial process. In the present embodiment, at the start of the initial process of FIG. 3, the transfer unit 5 is already attached to the main frame 2, and the drum cartridge 4 attached with the four developing cartridges 3 is also already attached to the main frame 2.

In S11 the controller 7 detects that the power is turned from the OFF state to the ON state or that the cover 22 is closed. For example, the controller 7 determines that the power is turned from the OFF state to the ON state upon detection of the start of current supply thereto. Alternatively, the controller 7 determines that the cover 22 is closed upon reception of a detection signal from the cover sensor 23.

When detecting that the power is turned from the OFF state to the ON state or that the cover 22 of the image forming apparatus 1 is closed (S11: YES), the controller 7 executes a latch process (S12). In the latch process, the controller 7 reads out information from the transfer memory 54.

Figure 4:
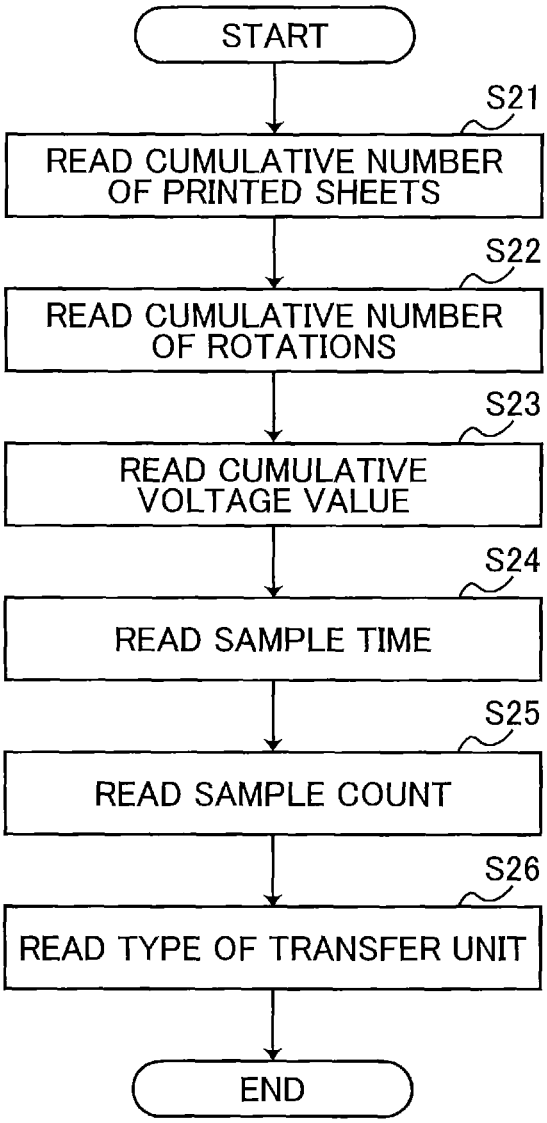
FIG. 4 is a flowchart illustrating a detailed flow of a latch process.

FIG. 4 is a flowchart illustrating the detailed flow of the latch process. As illustrated in FIG. 4, the controller 7 reads out, from the transfer memory 54, the cumulative number of printed sheets (S21), cumulative number of rotations (S22), cumulative voltage value (S23), sample time (S24), sample count (S25), and type of the transfer unit (S26). Then, the controller 7 writes the read-out cumulative number of printed sheets, cumulative number of rotations, cumulative voltage value, sample time, sample count and type of the transfer unit to the main memory 72.

The steps S21 to S26 may be performed in an order different from that illustrated in FIG. 4.

After completion of the latch process, the controller 7 reads out the contract information and the transfer unit type from the main memory 72. Then, the controller 7 sets a usage mode of the transfer unit 5 based on the read-out contract information and transfer unit type (S13).

FIG. 5 is a view illustrating an example of a table T illustrating a relationship between information (contract information and transfer unit type) and the usage mode of the transfer unit 5. In the table T, three usage modes of "usable/extendable", "usable/unextendable", and "unusable" are specified depending on the contract information and transfer unit type. The "usable/extendable" indicates that the attached transfer unit 5 is usable and the user can continue to use the transfer unit 5 even when the transfer unit 5 has been reached its operational lifetime. The "usable/unextendable" indicates that the attached transfer unit 5 is usable but the user cannot use the transfer unit 5 when the transfer unit 5 reaches its operational lifetime. The "unusable" indicates that the attached transfer unit 5 is unusable.

The table T is already stored in the main memory 72. The controller 7 reads out the table T from the main memory 72 and sets the usage mode of the transfer unit 5 based on the table T, and the above-described contract information and transfer unit type related to the attached transfer unit 5.

In the example of FIG. 5, when the transfer unit type is "first transfer unit", or when the transfer unit type and contract information are "second transfer unit" and "second contract", respectively, the controller 7 sets the usage mode to "usable/extendable". In this case, the controller 7 writes information indicating that the usage mode is "usable/extendable" to the main memory 72. When the transfer unit type and contract information are "second transfer unit" and "first contract", respectively, the controller 7 sets the usage mode to "usable/unextendable". In this case, the controller 7 writes information indicating that the usage mode is "usable/unextendable" to the main memory 72.

When the transfer unit type and contract information are "second transfer unit" and "normal", respectively, the controller 7 sets the usage mode to "unusable". In this case, the controller 7 writes information indicating that the usage mode is "usable" to the main memory 72. Also, in this case, the controller 7 displays, on the display 8, an error message. Specifically, the controller 7 displays, on the display 8, a message indicating that the attached transfer unit 5 is unusable.

The relationship between the information (contract information and transfer unit type) related the attached transfer unit 5 and usage mode of the transfer unit 5 is not limited to that illustrated in FIG. 5.

Subsequently, the controller 7 determines the remaining life of the transfer unit 5 (S14, lifetime determination process). Specifically, the controller 7 calculates the remaining life of the transfer unit 5 based on the information (cumulative number of printed sheets, cumulative number of rotations, and cumulative voltage value) read out in the latch process of S12. Then, when the calculated remaining life is shorter than a predetermined threshold value, the controller 7 determines that the transfer unit 5 has a short remaining life or has reached its operational lifetime. Details of the lifetime determination process will be described later. When determining in the lifetime determination process of S14 that a sufficient lifetime of the transfer unit 5 remains, in S15 the controller 7 waits for an input of a print instruction.

<4-2. Periodic Process>

Figure 6:
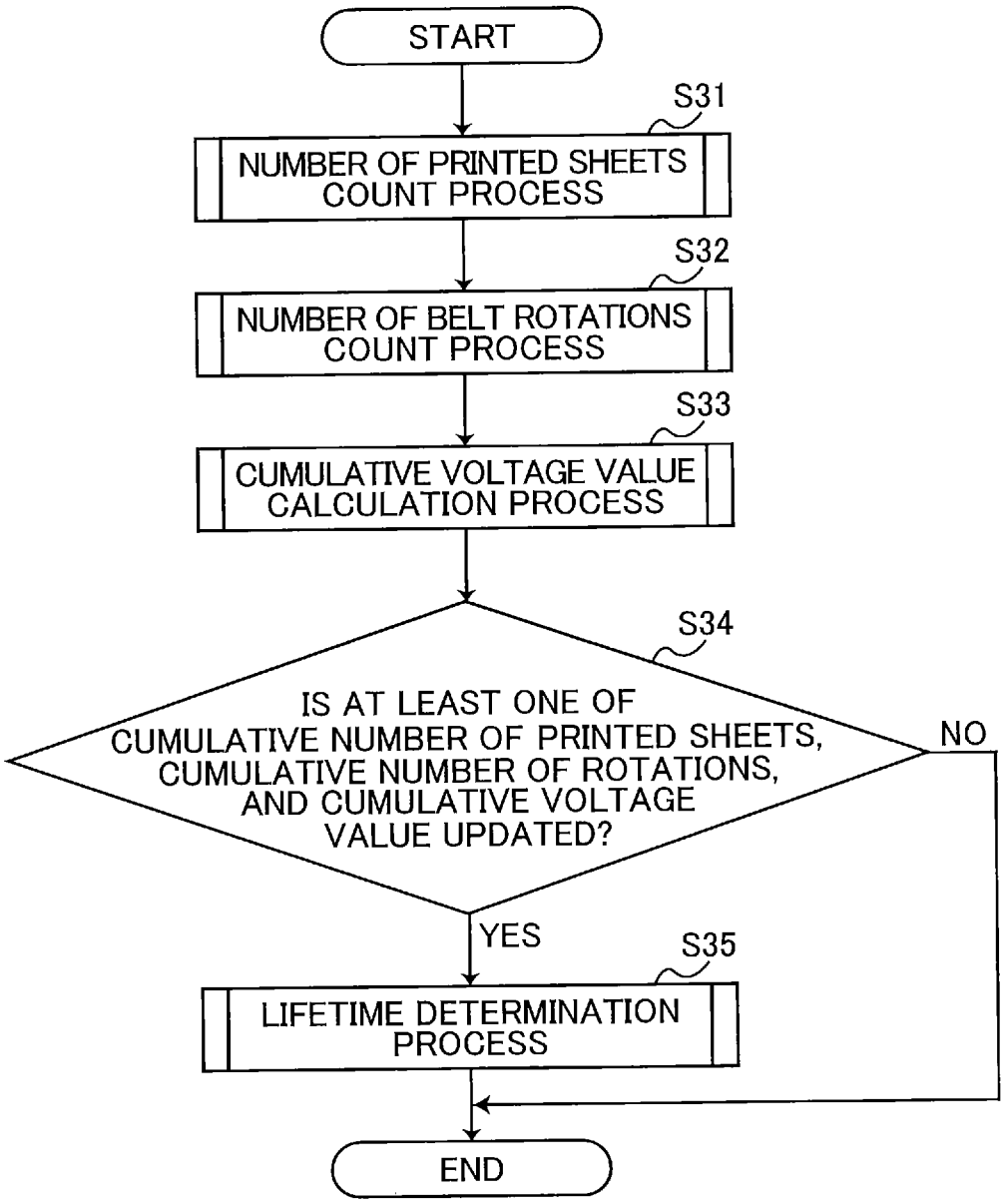
FIG. 6 is a flowchart illustrating steps in a periodic process.

Subsequently, a periodic process will be described. The periodic process is a process that the controller 7 repeatedly executes at predetermined time intervals after completion of the above initial process. FIG. 6 is a flowchart illustrating steps of the periodic process.

Figure 7:
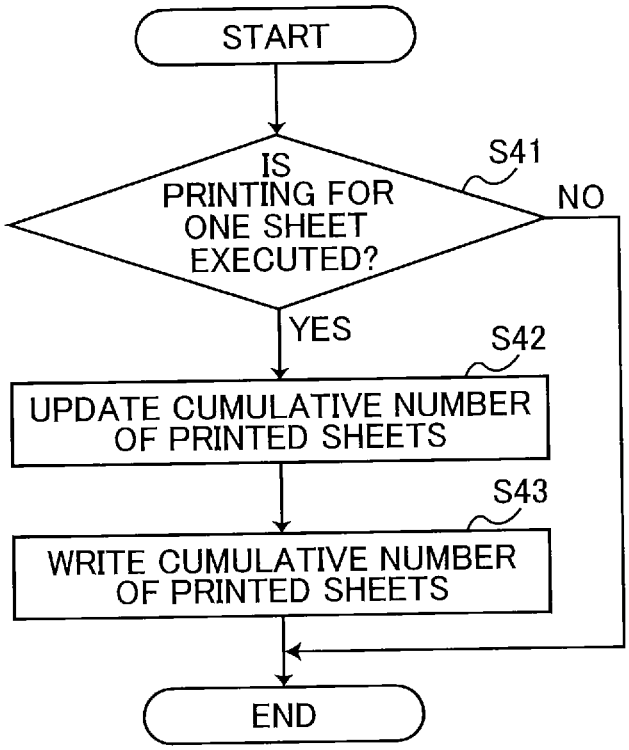
FIG. 7 is a flowchart illustrating steps in a number-of-printed-sheets count process.

The controller 7 counts the cumulative number of printed sheets (S31, number-of-printed-sheet count process). FIG. 7 is a flowchart illustrating steps of the number-of-printed-sheet count process. In the number-of-printed-sheet count process, in S41 the controller 7 determines whether print process for one sheet is executed. When determining the print process for one sheet is not executed (S41: NO), the controller 7 completes the number-of-printed-sheet count process.

On the other hand, when determining in S41 that the print process for one sheet is executed (S41: YES), the controller 7 updates the cumulative number of printed sheets stored in the main memory 72 (S42). Specifically, the controller 7 increments the cumulative number of printed sheets stored in the main memory 72. Then, in S43 the controller 7 writes the updated cumulative number of printed sheets to the transfer memory 54.

Figure 8:
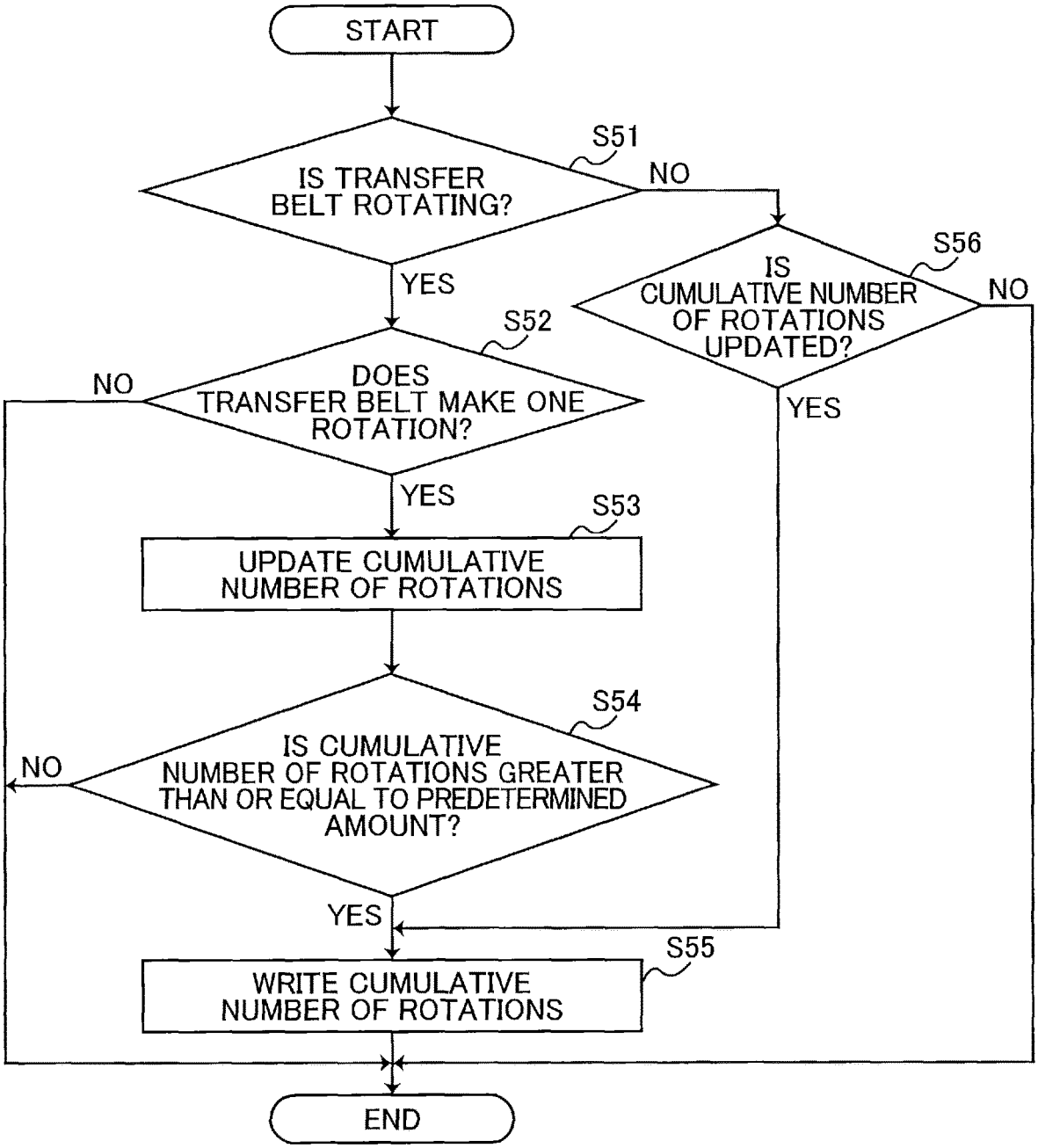
FIG. 8 is a flowchart illustrating steps in a number-of-belt-rotations count process.

Then, the controller 7 counts the cumulative number of rotations (S32, number-of-belt-rotation count process). FIG. 8 is a flowchart illustrating steps of the number-of-belt-rotation count process. In the number-of-belt-rotation count process, the controller 7 determines whether the transfer belt 52 is rotating (S51). When determining that the transfer belt 52 is rotating (S51: YES), the controller 7 determines whether the transfer belt 52 make one rotation (S52). When determining that the transfer belt 52 does not make one rotation (S52: NO), the controller 7 completes the number-of-belt-rotation count process.

On the other hand, when determining in S52 that the transfer belt 52 make one rotation (S52: YES), in S53 the controller 7 updates the cumulative number of rotations stored in the main memory 72. Specifically, the controller 7 increments the cumulative number of rotations stored in the main memory 72. Then, the controller 7 determines whether the cumulative number of rotations has increased by a predetermined amount since the previous writing of the cumulative number of rotations to the transfer memory 54. When determining that the cumulative number of rotations has not increased by the predetermined amount since the previous writing of the cumulative number of rotations to the transfer memory 54 (S54: NO), the controller 7 completes the number-of-belt-rotation count process.

On the other hand, when determining in S54 that the cumulative number of rotations has increased by the predetermined amount since the previous writing of the cumulative number of rotations to the transfer memory 54 (S54: YES), in S55 the controller 7 writes the updated cumulative number of rotations to the main memory 72.

When determining in S51 that the transfer belt 52 is not rotating (S51: NO), the controller 7 determines whether the cumulative number of rotations is updated (S56). For example, when "no" is determined in S54 in the previous number-of-belt-rotation count process, and "no" is determined in S51 of the current number-of-belt-rotation count process, it is determined that the cumulative number of rotations is updated. When determining that the cumulative number of rotations is updated (S56: YES), in S55 the controller 7 writes the updated cumulative number of rotations to the transfer memory 54. On the other hand, when determining in S56 that the cumulative number of rotations is not updated (S56: NO), the controller 7 completes the number-of-belt-rotation count process.

Figure 9:
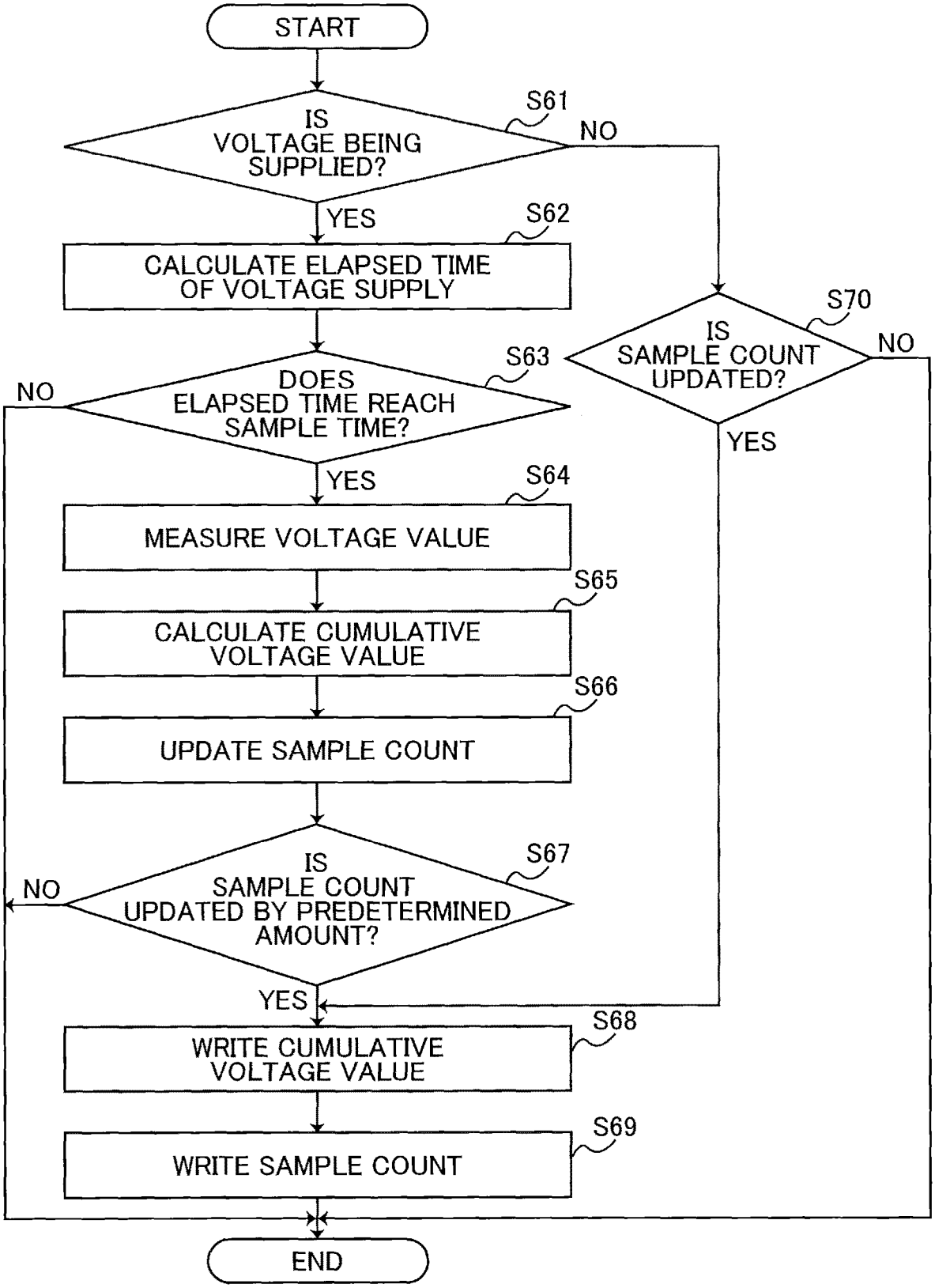
FIG. 9 is a flowchart illustrating steps in a cumulative-voltage-value calculation process.

Then, the controller 7 calculates the cumulative voltage value (S33, cumulative-voltage-value calculation process). FIG. 9 is a flowchart illustrating steps of the cumulative-voltage-value calculation process. In the cumulative-voltage-value calculation process, in S61 the controller 7 determines whether a voltage is being supplied from the voltage supply circuit 6 to the transfer rollers 53. When determining that a voltage is being supplied from the voltage supply circuit 6 to the transfer rollers 53 (S61: YES), in S62 the controller 7 calculates an elapsed time of the voltage supply from the voltage supply circuit 6 to the transfer rollers 53.

Subsequently, in S63 the controller 7 determines whether the elapsed time of the voltage supply from the voltage supply circuit 6 to the transfer rollers 53 reaches the above-described sample time. When determining that the elapsed time of the voltage supply from the voltage supply circuit 6 to the transfer rollers 53 does not reach the sample time (S63: NO), the controller 7 completes the cumulative-voltage-value calculation process.

On the other hand, when determining in S63 that the elapsed time of the voltage supply from the voltage supply circuit 6 to the transfer rollers 53 reaches the sample time (S63: YES), in S64 the controller 7 measures a voltage value supplied from the voltage supply circuit 6 to the transfer rollers 53. Then, in S65 the controller 7 calculates the cumulative voltage value. Specifically, the controller 7 adds the voltage value measured in S64 to a cumulative voltage value calculated in the previous cumulative-voltage-value calculation process thereby calculating the current cumulative voltage value. Then, the controller 7 writes the calculated cumulative voltage value to the main memory 72.

Further, in S66 the controller 7 updates the sample count. Specifically, the controller 7 increments the sample count. Then, the controller 7 writes the updated sample count to the main memory 72. The steps S65 and S66 may be performed in the reverse order.

Thereafter, in S67 the controller 7 determines whether the sample count is updated by a predetermined amount or more since the previous writing of the sample count to the transfer memory 54. When determining that the sample count is not updated by the predetermined amount or more since the previous writing of the sample count to the transfer memory 54 (S67: NO), the controller 7 completes the cumulative-voltage-value calculation process.

On the other hand, when determining that the sample count is updated by the predetermined amount or more since the previous writing of the sample count to the transfer memory 54 (S67: YES), the controller 7 writes the cumulative voltage value calculated in S65 to the transfer memory 54 (S68, cumulative-voltage-value writing process). Further, in S69 the controller 7 writes the sample count updated in S66 to the transfer memory 54. The steps S68 and S69 may be performed in the reverse order.

Further, when determining in S61 that a voltage is not being supplied from the voltage supply circuit 6 to the transfer rollers 53 (S61: NO), in S70 the controller 7 determines whether the sample count is updated. For example, when "no" is determined in S67 in the previous cumulative-voltage-value calculation process, and "no" is determined in S61 of the current cumulative-voltage-value calculation process, it is determined that the sample count has been updated. In this case, the cumulative voltage value is also updated. When determining that the sample count is updated (S70: YES), the controller 7 writes the updated cumulative voltage value and updated sample count to the transfer memory 54 (steps S68 and S69). On the other hand, when determining in S70 that the sample count is not updated (S70: NO), the controller 7 completes the cumulative-voltage-value calculation process.

Referring back to FIG. 6, the controller 7 may perform steps S31 to S33 in any order. After completion of steps S31 to S33, in S34 the controller 7 determines whether at least one of the cumulative number of printed sheets, cumulative number of rotations, and cumulative voltage value is updated. When determining none of the cumulative number of printed sheets, cumulative number of rotations, and cumulative voltage value is updated (S34: NO), the controller 7 completes the periodic process.

On the other hand, when determining in S34 that at least one of the cumulative number of printed sheets, cumulative number of rotations, and cumulative voltage value is updated (S34: YES), the controller 7 checks the remaining life of the transfer unit 5 (S35, lifetime determination process). Specifically, the controller 7 calculates the remaining life of the transfer unit 5 based on the cumulative number of printed sheets, cumulative number of rotations, and cumulative voltage value. Then, when the calculated remaining life is shorter than a predetermined threshold value, the controller 7 determines that the transfer unit 5 has a short remaining life or reaches its operational lifetime.

Figure 10:
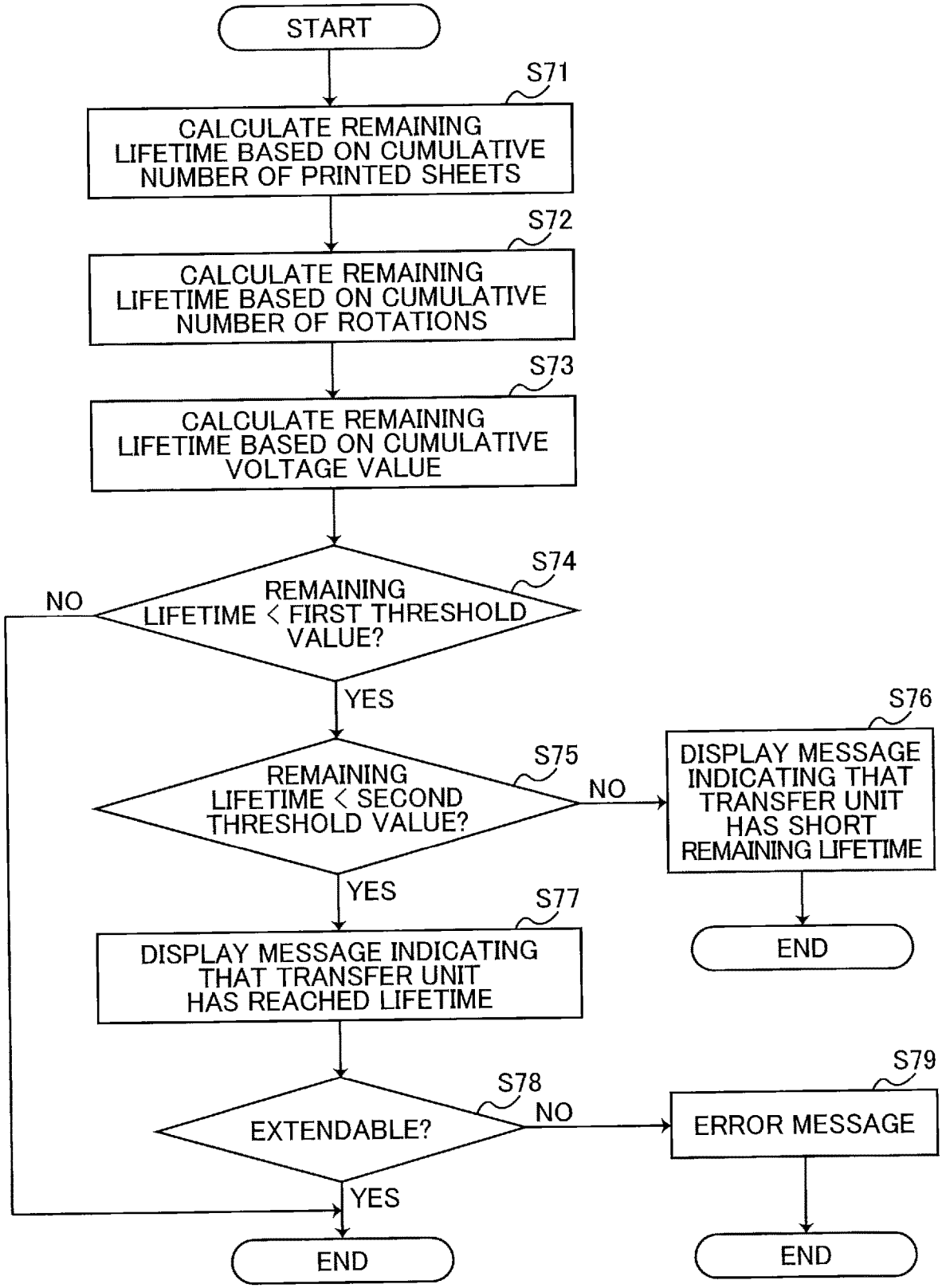
FIG. 10 is a flowchart illustrating steps in a lifetime determination process.

FIG. 10 is a flowchart illustrating the detailed flow of the lifetime determination process performed in steps S14 and S35.

First, in the lifetime determination process, in S71 the controller 7 calculates a remaining life L1 based on the cumulative number of printed sheets. The main memory 72 previously stores an upper limit value of the number of sheets to be printed (hereinafter, referred to as "lifetime print number of sheets") using the transfer unit 5. The controller 7 uses, for example, the following equation (1) to calculate the remaining life L1 based on the cumulative number of printed sheets. That is, the controller 7 calculates, as the remaining life L1, a percentage of the value obtained by dividing the remaining number of printed sheets, which is obtained by subtracting the cumulative number of printed sheets from the lifetime print number of sheets, by the lifetime printable number of sheets.

$$L1(\%)=\{(\text{lifetime print number of sheets}-\text{cumulative number of printed sheets})/\text{lifetime print number of sheets}\}\times 100 \quad (1)$$

Further, in S72 the controller 7 calculates a remaining life L2 based on the cumulative number of rotations. The main memory 72 previously stores an upper limit value (hereinafter, referred to as "lifetime number of rotations") of the number of rotations of the transfer belt 52. The controller 7 uses, for example, the following equation (2) to calculate the remaining life L2 based on the cumulative number of rotations. That is, the controller 7 calculates, as the remaining life L2, a percentage of the value obtained by dividing the remaining number of rotations, which is obtained by subtracting the cumulative number of rotations from the lifetime number of rotations, by the lifetime number of rotations.

$$L2(\%)=\{(\text{lifetime number of rotations}-\text{cumulative number of rotations})/\text{lifetime number of rotations}\}\times 100 \quad (2)$$

Further, in S73 the controller 7 calculates a remaining life L3 based on the cumulative voltage value. The controller 7 multiplies the sample time and cumulative voltage value to calculate a consumption amount. The main memory 72 previously stores an upper limit value (hereinafter, referred to as "lifetime consumption amount") of the consumption amount. The controller 7 uses, for example, the following equation (3) to calculate the remaining life L3 based on the cumulative voltage value. That is, the controller 7 calculates, as the remaining life L3, a percentage of the value obtained by dividing the remaining consumption amount, which is obtained by subtracting the consumption amount from the lifetime consumption amount, by the lifetime consumption amount.

$$L3(\%)=\{(\text{lifetime consumption amount}-\text{consumption amount})/\text{lifetime consumption amount}\}\times 100 \quad (3)$$

The controller 7 may perform steps S71 to S73 in any order. Further, the controller 7 may calculate the above remaining life L1, L2, and L3 using methods different from those described above.

After completion of steps S71 to S73, the controller 7 selects the smallest remaining life (hereinafter, referred to as "minimum remaining life") from among the remaining life L1 based on the cumulative number of printed sheets, remaining life L2 based on the cumulative number of rotations, and remaining life L3 based on the cumulative voltage value. Then, in S74, the controller 7 determines whether the selected minimum remaining life is smaller than a preset first threshold value.

When determining that the minimum remaining life is equal to or more than the first threshold value (S74: NO), the controller 7 completes the lifetime determination process. In this case, it is determined that a sufficient lifetime remains, and thus the controller 7 does not display, on the display 8, a message related to the operational lifetime.

On the other hand, when determining in S74 that the minimum remaining life is less than the first threshold value (S74: YES), in S75 the controller 7 determines whether the minimum remaining life is less than a preset second threshold value. The second threshold value is smaller than the first threshold value. When determining that the minimum remaining life is equal to or more than the second threshold value (S75: NO), in S76 the controller 7 displays, on the display 8, a message indicating that the transfer unit 5 has a short remaining life.

On the other hand, when determining in S75 that the minimum remaining life is less than the second threshold value (S75: YES), in S77 the controller 7 displays, on the display 8, a message indicating that the transfer unit 5 has reached its lifetime. In this case, the controller 7 reads out the usage mode stored in the main memory 72. Then, in S78 the controller 7 determines whether the usage mode is either "usable/extendable" or "usable/unextendable".

When determining that the usage mode is "usable/extendable" (S78: YES), the controller 7 completes the lifetime determination process. In this case, the controller 7 allows continuous use of the transfer unit 5. That is, the controller 7 waits for an input of a next print instruction.

On the other hand, when determining in S78 that the usage mode is "usable/unextendable" (S78: NO), in S79 the controller 7 outputs an error. Specifically, the controller 7 displays an error message on the display 8. In this case, the controller 7 restricts continuous use of the transfer unit 5. That is, the controller 7 restricts execution of print process until the current transfer unit 5 is replaced with a new one.

As described above, in the image forming apparatus 1, the controller 7 determines the remaining life of the transfer unit 5 based on the cumulative number of printed sheets, cumulative number of rotations, and cumulative voltage value. That is, the factors for determining the remaining life of the transfer unit 5 include the cumulative voltage value. This allows the lifetime of the transfer unit 5 to be appropriately determined in consideration of degradation of the transfer roller 53 due to repeated voltage supply from the voltage supply circuit 6 to the transfer roller 53 or defects in a printed image.

Further, in the image forming apparatus 1, the controller 7 writes the calculated cumulative voltage value and sample count to the transfer memory 54. Thus, even when the transfer unit 5 in use is detached from the main frame 2, the cumulative voltage value can be retained in the transfer memory 54 of the transfer unit 5. In this case, when the transfer unit 5 is attached again to the main frame 2, the controller 7 reads out the cumulative voltage value and sample count from the transfer memory 54 and thereby can appropriately calculate the remaining life L3 based on the cumulative voltage value of the transfer unit 5.

Further, in the image forming apparatus 1, the controller 7 sets the usage mode of the transfer unit 5 based on the transfer unit type read out from the transfer memory 54. Then, when determining that the transfer unit 5 has reached its lifetime, the controller 7 allows or restricts continuous use of the transfer unit 5 according to the usage mode. Thus, continuous use of the transfer unit 5 can be allowed or restricted in a proper way according to the type of the transfer unit 5.

Further, in the image forming apparatus 1, the controller 7 sets the usage mode of the transfer unit 5 based on the contract information read out from the main memory 72. Then, when determining that the transfer unit 5 has reached its lifetime, the controller 7 allows or restricts continuous use of the transfer unit 5 according to the usage mode. Thus, continuous use of the transfer unit 5 can be allowed or restricted in a proper way according to the contract information.

<5. Modifications>

While the embodiment of the present disclosure has been described in detail, the present disclosure is not limited to the above embodiment. Various modifications will be described focusing differences from the above embodiment.

In the above embodiment, the sample time is stored in the transfer memory 54. However, the sample time may be previously stored in the main memory 72.

Further, in the above embodiment, in S76, the controller 7 displays, on the display 8, a message indicative of a short remaining life irrespective of the contract information. However, the controller 7 may determine whether to display the message in S76 according to the contract information. For example, when the subscription contract is concluded, a user need not prepare a new transfer unit 5 for when the current transfer unit 5 reaches its lifetime. Thus, when the contract information indicates either "first contract" or "second contract", the controller 7 need not display, on the display 8, a message indicative of the transfer unit 5 having a short remaining life.

Further, in the above embodiment, four developing cartridges 3 are attached to the drum cartridge 4. However, the number of the developing cartridges 3 to be attached to the drum cartridge 4 may be one to three, or five or more.

Further, the number of the transfer rollers 53 that the transfer unit 5 has may be one to four, or five or more. When the number of the transfer rollers 53 is one, the transfer unit 5 need not have the transfer belt 52.

Further, in the above embodiment, the transfer unit 5 is detachably attached to the main frame 2. However, the transfer unit 5 need not be detachable from the main frame 2. In this case, the lifetime of the image forming apparatus 1 including the transfer unit 5 may be determined in the lifetime determination process.

Figure 11:
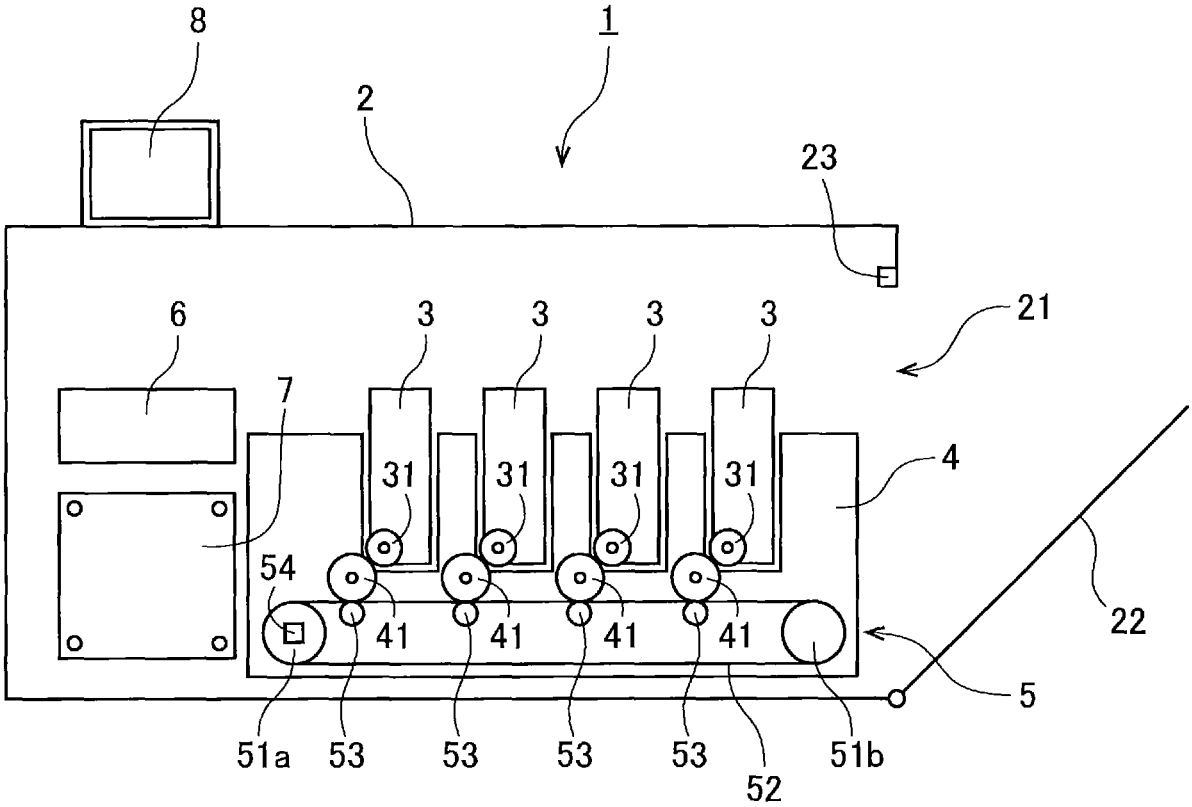
FIG. 11 is a conceptual view of an image forming apparatus according to a modification of the embodiment.

Further, in the above embodiment, the transfer unit 5 has the transfer belt 52. However, the transfer unit 5 need not have the transfer belt 52. For example, the transfer rollers 53 may directly contact a print sheet without contacting through the transfer belt 52. Further, in the above embodiment, the drum cartridge 4 and the transfer unit 5 are separately provided. However, the drum cartridge 4 and the transfer unit 5 may be integrally provided. For example, as illustrated in FIG. 11, the drum cartridge 4 may integrally include the transfer unit 5. In this case, the lifetime of the transfer unit 5 may be regarded as the lifetime of the drum cartridge 4. Further, when the drum cartridge 4 integrally includes the transfer unit 5, whether the extended use of the drum cartridge 4 is allowed may be determined based on the lifetime of the transfer unit 5. Further, the developing cartridge 3 and the transfer unit 5 may be integrally provided. In this case, the lifetime of the transfer unit 5 may be regarded as the lifetime of the developing cartridge 3. Further, when the developing cartridge 3 and the transfer unit 5 are integrally provided, whether the extended use of the developing cartridge 3 is allowed may be determined based on the lifetime of the transfer unit 5.

Further, detailed shapes of the components constituting the image forming apparatus and details of the process that the controller performs may be changed as needed. Further, parts and components appearing in the embodiments and modifications may be suitably combined together and omitted as long as any conflicting structure is avoidable.

What is claimed is:

1. An image forming apparatus comprising:

a photosensitive drum;

a transfer unit configured to transfer developer onto a printing medium from the photosensitive drum;

a voltage supply circuit configured to supply voltage to the transfer unit; and a controller electrically connected to the voltage supply circuit, the controller being configured to:

calculate a cumulative voltage value, the cumulative voltage value being a total of supplied voltage to the transfer unit from the voltage supply circuit after using the transfer unit is started; and determine how long a lifetime of the transfer unit remains based on the calculated cumulative voltage value.

2. The image forming apparatus according to claim 1, further comprising a main frame, wherein the transfer unit is attachable to and detachable from the main frame.

3. The image forming apparatus according to claim 2, further comprising a main memory i-s-configured to store therein contract information indicating whether a contract related to the transfer unit is concluded or indicating type of a contract, wherein the controller is configured to:

read the contract information from the transfer memory; and in a case where the controller determines that the transfer unit reaches the lifetime, allow or restrict an extended use of the transfer unit after the transfer unit reaches the lifetime in accordance with the contract information.

4. The image forming apparatus according to claim 2, further comprising a drum cartridge including the photosensitive drum, the drum cartridge being attachable to and detachable from the main frame.

5. The image forming apparatus according to claim 4, wherein the drum cartridge includes the transfer unit.

6. The image forming apparatus according to claim 1, wherein the transfer unit comprising:

a transfer roller; and a transfer belt having annular shape and positioned between the photosensitive drum and the transfer roller, wherein the voltage supply circuit is configured to supply the voltage to the transfer roller.

7. The image forming apparatus according to claim 6, wherein the controller is further configured to:

count a cumulative number of printed sheets indicating cumulative number of sheets printed using the transfer unit after using the transfer unit in the image forming apparatus is started;

count a cumulative number of rotations indicating cumulative number of rotations of the transfer belt after using the transfer unit in the image forming apparatus is started;

calculate at least one of a first remaining life of the transfer unit based on the cumulative number of printed sheets, a second remaining life of the transfer unit based on the cumulative number of rotations and a third remaining life of the transfer unit based on the cumulative voltage value; and in a case where the controller determines how long a lifetime of the transfer unit remains based on the calculated cumulative voltage value, determine that the transfer unit has a short remaining life or reaches the lifetime when at least one of the first remaining life, the second remaining life and the third remaining life is shorter than a predetermined value previously set.

8. The image forming apparatus according to claim 1, wherein the controller is configured to calculate the cumulative voltage value by adding voltage value supplied from the voltage supply circuit to the transfer unit every predetermined sample time.

9. The image forming apparatus according to claim 8, wherein the controller is configured to determine how long the lifetime of the transfer unit remains based on a consumption amount calculated by multiplying the sample time and the cumulative voltage value.

10. The image forming apparatus according to claim 1, wherein the transfer unit includes a transfer memory is configured to store the cumulative voltage value.

11. The image forming apparatus according to claim 10, wherein the controller is configured to perform writing the calculated cumulative voltage value to the transfer memory.

12. The image forming apparatus according to claim 10, wherein the transfer memory is configured to store therein type information of the transfer unit, and wherein the controller is configured to:

read the type information of the transfer unit from the transfer memory; and in a case where the controller determines that the transfer unit reaches the lifetime, allow or restrict an extended use of the transfer unit after the transfer unit reaches the lifetime in accordance with the type information of the transfer unit.

13. The image forming apparatus according to claim 1, further comprising a display, wherein, in a case where the controller determines that the transfer unit has a short remaining life or reaches the lifetime, the controller is configured to display, on the display, a message indicating the transfer unit has a short remaining life or reaches the lifetime.

* * * * *